US010274159B2

(12) United States Patent
Kim

(10) Patent No.: US 10,274,159 B2
(45) Date of Patent: Apr. 30, 2019

(54) LENSES AND METHODS FOR DIRECTING LIGHT TOWARD A SIDE OF A LUMINAIRE

(71) Applicant: RAB Lighting Inc., Northvale, NJ (US)

(72) Inventor: Brian Kim, Northvale, NJ (US)

(73) Assignee: RAB Lighting Inc., Northvale, NJ (US)

( * ) Notice: Subject to any disclaimer, the term of this patent is extended or adjusted under 35 U.S.C. 154(b) by 0 days.

(21) Appl. No.: 15/644,413

(22) Filed: Jul. 7, 2017

(65) Prior Publication Data

US 2019/0011110 A1 Jan. 10, 2019

(51) Int. Cl.

| | |
|---|---|
| ***F21V 13/04*** | (2006.01) |
| ***F21V 29/83*** | (2015.01) |
| ***F21Y 115/10*** | (2016.01) |
| ***F21V 5/04*** | (2006.01) |
| ***F21V 7/00*** | (2006.01) |
| ***F21V 7/09*** | (2006.01) |

(52) U.S. Cl.

CPC ..... *F21V 5/04* (2013.01); *F21V 7/0091* (2013.01); *F21V 13/04* (2013.01); *F21V 29/83* (2015.01); *F21V 7/09* (2013.01); *F21Y 2115/10* (2016.08)

(58) Field of Classification Search

CPC ..... F21V 5/045–5/048; F21V 7/0091; F21V 7/04–7/09

See application file for complete search history.

(56) References Cited

U.S. PATENT DOCUMENTS

| | | | | |
|---|---|---|---|---|
| 6,837,605 | B2 | 1/2005 | Reill | |
| 7,182,480 | B2 | 2/2007 | Kan | |
| 7,251,084 | B2 | 7/2007 | Shimura | |
| 7,445,359 | B2 | 11/2008 | Chang | |
| 7,461,960 | B2 | 12/2008 | Opolka et al. | |
| 7,580,192 | B1 | 8/2009 | Chu et al. | |
| 7,618,163 | B2 * | 11/2009 | Wilcox | F21V 5/04 362/268 |
| 7,674,018 | B2 | 3/2010 | Holder et al. | |
| 7,766,509 | B1 | 8/2010 | Laporte | |

(Continued)

FOREIGN PATENT DOCUMENTS

| | | |
|---|---|---|
| CN | 202266986 | 6/2012 |
| CN | 203413542 | 1/2014 |

(Continued)

*Primary Examiner* — Mariceli Santiago

(74) *Attorney, Agent, or Firm* — Frost Brown Todd LLC; Douglas G. Gallagher; Kevin C. Oschman

(57) ABSTRACT

Lenses and methods for directing light toward a side of light fixture, and methods for manufacturing the same, are disclosed. Embodiments include lenses with an optical axis and a first (e.g., upper) portion that is rotationally symmetric about the optical axis and a second (e.g., lower) portion that is rotationally asymmetric. The first/upper portion can include a cavity that receives an LED and directs light toward the second/lower portion. The asymmetric side can include a convex surface where the light exits the lens, the convex surface extending across the optical axis. Additional embodiments include a planar surface adjacent the convex surface, where the height of the lens decreases along the portion of the convex surface near the planar surface and along the planar surface as the distance from the optical axis increases. In further embodiments, the maximum height of the lens occurs between two horizontal sides of the lens.

35 Claims, 7 Drawing Sheets

(56) References Cited

U.S. PATENT DOCUMENTS

| | | | | |
|---|---|---|---|---|
| 7,841,750 | B2 | 11/2010 | Wilcox et al. | |
| 7,843,654 | B2 | 11/2010 | Destain | |
| 7,854,536 | B2 | 12/2010 | Holder et al. | |
| 7,866,837 | B2 | 1/2011 | Ho | |
| 7,891,835 | B2 | 2/2011 | Wilcox | |
| 7,934,858 | B2 | 5/2011 | Nakamura | |
| 7,942,559 | B2 | 5/2011 | Holder et al. | |
| 7,959,326 | B2 * | 6/2011 | Laporte | F21V 5/007 362/249.02 |
| 7,985,009 | B2 | 7/2011 | Ho | |
| 8,132,942 | B2 | 3/2012 | Holder et al. | |
| 8,220,958 | B2 | 7/2012 | Montagne | |
| 8,282,239 | B2 | 10/2012 | Wilcox | |
| 8,348,475 | B2 | 1/2013 | Wilcox et al. | |
| 8,414,161 | B2 | 4/2013 | Holder et al. | |
| 8,454,205 | B2 | 6/2013 | Holder et al. | |
| 8,465,190 | B2 | 6/2013 | Taskar et al. | |
| 8,496,360 | B2 | 7/2013 | Phillips, III et al. | |
| 8,511,854 | B2 | 8/2013 | Wilcox | |
| 8,591,074 | B1 | 11/2013 | Jiang et al. | |
| 8,764,232 | B2 | 7/2014 | Wilcox | |
| 8,820,979 | B2 | 9/2014 | Lee et al. | |
| 8,911,118 | B2 | 12/2014 | Zhang et al. | |
| 9,052,086 | B2 | 6/2015 | Broughton | |
| 9,080,746 | B2 | 7/2015 | Chen et al. | |
| 9,127,819 | B2 | 9/2015 | Wilcox | |
| 9,200,765 | B1 | 12/2015 | Broughton | |
| 9,206,957 | B2 | 12/2015 | Taskar et al. | |
| 9,234,650 | B2 * | 1/2016 | Dieker | F21V 13/04 |
| 9,255,686 | B2 | 2/2016 | Wilcox et al. | |
| 9,291,334 | B2 | 3/2016 | Grassi | |
| 9,297,517 | B2 | 3/2016 | Holder et al. | |
| 9,297,520 | B2 | 3/2016 | Holder et al. | |
| 9,360,169 | B2 * | 6/2016 | Zhang | G02B 19/0028 |
| 9,388,949 | B2 | 7/2016 | Holder et al. | |
| 9,410,674 | B2 | 8/2016 | Goldstein et al. | |
| 2007/0153402 | A1 | 7/2007 | Destain | |
| 2008/0030990 | A1 | 2/2008 | Hanney | |
| 2008/0174993 | A1 | 7/2008 | Hsieh et al. | |
| 2010/0039810 | A1 | 2/2010 | Holder et al. | |
| 2010/0128488 | A1 | 5/2010 | Marcoux | |
| 2010/0207143 | A1 | 8/2010 | Tsai et al. | |
| 2010/0296283 | A1 * | 11/2010 | Taskar | F21V 5/04 362/235 |
| 2011/0038151 | A1 * | 2/2011 | Carraher | F21S 8/08 362/242 |
| 2011/0063857 | A1 | 3/2011 | Li et al. | |
| 2011/0096533 | A1 | 4/2011 | Sekela et al. | |
| 2011/0096553 | A1 | 4/2011 | Shimokawa | |
| 2011/0242807 | A1 | 10/2011 | Little, Jr. et al. | |
| 2012/0039077 | A1 | 2/2012 | Householder | |
| 2012/0050889 | A1 | 3/2012 | Lu et al. | |
| 2012/0075866 | A1 | 3/2012 | Chang | |
| 2012/0120666 | A1 * | 5/2012 | Moeller | F21V 5/04 362/308 |
| 2012/0195040 | A1 | 8/2012 | Treanton | |
| 2012/0287649 | A1 | 11/2012 | Kelley | |
| 2012/0300488 | A1 | 11/2012 | Broughton | |
| 2012/0307495 | A1 | 12/2012 | Shih | |
| 2014/0063802 | A1 | 3/2014 | Garcia | |
| 2014/0085905 | A1 | 3/2014 | Broughton | |
| 2014/0126206 | A1 | 5/2014 | Wilcox et al. | |
| 2014/0192521 | A1 | 7/2014 | Laakkio | |
| 2014/0268762 | A1 | 9/2014 | Raleigh et al. | |
| 2016/0116135 | A1 | 4/2016 | Wilcox et al. | |
| 2016/0208998 | A1 | 7/2016 | Greinke | |

FOREIGN PATENT DOCUMENTS

| | | |
|---|---|---|
| CN | 203642077 | 6/2014 |
| CN | 102506384 | 10/2014 |
| CN | 104316984 | 1/2015 |
| CN | 102829430 | 12/2016 |
| EP | 1048085 | 11/2007 |
| EP | 1880139 | 1/2008 |
| EP | 2708806 | 3/2014 |
| EP | 2924345 | 9/2015 |
| FR | 2976999 | 12/2012 |

* cited by examiner

LENSES AND METHODS FOR DIRECTING LIGHT TOWARD A SIDE OF A LUMINAIRE

FIELD

Embodiments of this disclosure relate generally to lighting fixtures and, more particularly, to an improved wall wash LED lighting fixture with lenses for directing light toward a common direction.

BACKGROUND

Wall wash lighting fixtures can be used to illuminate a surface, typically a wall, but also a ceiling, floor, picture, painting, or combination thereof, and to permit the aiming of the light relative to the surface onto which the wall wash fixture is installed. Wall wash lighting can be used as a design technique to make small spaces appear bigger—since there is an added emphasis to vertical surfaces, the human eye tends to perceive a room with wall washers as larger. For at least this reason, wall wash lights can be used in rooms that are smaller in size.

Further, light emitting diodes (LEDs) have become an increasingly popular lighting source in various luminaires, including wall wash fixtures. LEDs have been recognized as providing increased efficiency and decreased costs relative to conventional lighting sources and can offer other advantages including long life, compact size, and direct illumination. For the purposes of cost efficiency, it can be desirable to adapt lighting sources to be compatible with common LEDs, especially when the lighting sources are used in large-scale commercial environments. Additionally, for increased performance, it can be desirable to distribute the light emanating from a lighting fixture, such as a wall wash lighting fixture, in a manner which uniformly spreads the light across a surface.

SUMMARY

It was realized by the inventor of the present disclosure that difficulties exist with lighting fixtures, and in particular deep regress LED lighting fixtures that are used to angle light to one side of the fixture, such as to illuminate a wall instead of the floor below the fixture, and that improvements in LED lighting are needed. It was also realized by the inventor that advantages can be realized by providing a specialized lens to cast the light to one side of the fixture and to create a uniform light distribution pattern with few or no hot spots. The present disclosure is responsive to at least such an endeavor and at least some embodiments are directed to one or more of the problems or issues set forth above, and may be directed to other problems as well.

Embodiments of the present disclosure provide improved lenses and methods for directing light toward a side of a luminaire, e.g., light fixture.

Further embodiments of the present disclosure provide improved wall washer lenses and methods.

At least one embodiment of the present disclosure includes a lens for an LED light fixture, comprising: a lens defining an optical axis and configured to direct light toward a common side of the optical axis, the lens including first and second ends, the first end of the lens defining a cavity configured to receive an LED light source, the first end portion being configured to direct light from an LED light source received within the cavity to the second end of the lens, the first end being rotationally symmetric with respect to the optical axis, and the second end of the lens defining an exterior surface configured to emit light received from the first end, the second end being rotationally asymmetric with respect to the optical axis, and the exterior surface including a convex section and a first planar section adjacent one another, wherein the height of the lens decreases in the first planar section as the distance from the optical axis increases.

An alternate embodiment of the present disclosure includes a method, comprising: receiving a first portion of LED light propagating from an LED defining an optical axis, wherein the first portion of LED light propagates within a cone of a predetermined angle centered on the LED optical axis with a vertex collocated with the LED; directing the received first portion of LED light to align more with the optical axis; redirecting the first portion of LED light toward a preferred side of the LED optical axis with a curved refractive surface; receiving a second portion of LED light propagating from the LED outside the cone of a predetermined angle centered on the LED optical axis with a vertex collocated with the LED; directing the received second portion of LED light toward a reflective surface; reflecting the directed second portion of LED light to align more with the optical axis; and redirecting the reflected second portion of LED light toward the preferred side of the LED optical axis with a planar refractive surface.

A further embodiment of the present disclosure includes a lens for an LED light fixture, comprising: a lens defining an optical axis and including a first end rotationally symmetric in relation to the optical axis and defining a cavity configured to receive an LED light source, and a second end rotationally asymmetric in relation to the optical axis; and means for directing light toward a common side of the optical axis.

Yet other embodiments include the features described in any of the previously described three (3) embodiments, as combined with (i) one or more of the other two (2) previously described embodiments, (ii) one or more of the following aspects described in this summary, or (iii) one or more of the other two (2) previously described embodiments and one or more of the following aspects described in this summary:

Wherein the common side of the optical axis is defined by a longitudinal axis, and wherein the lens directs light at a radiant intensity that results in the light reaching a wall with constant brightness along a direction parallel to the optical axis, and wherein the wall is perpendicular to the longitudinal axis.

Wherein the first end includes an internally reflective surface.

Wherein the cavity includes a central convex surface disposed in a generally perpendicular orientation to the optical axis and configured to refract light emanating from an LED light source positioned within the cavity in a direction more aligned with the optical axis.

Wherein the cavity includes a side cylindrical surface disposed in a direction generally parallel to the optical axis and configured to refract light emanating from an LED light source positioned within the cavity toward the internally reflective surface.

Wherein the cavity includes the internally reflective surface reflects light received from the side cylindrical surface in a direction more aligned with the optical axis.

Wherein the optical axis separates a taller side of the lens from a shorter side of the lens and the height of the lens is measured in a direction parallel to the optical axis, and wherein the taller side is disposed on the common side of the optical axis.

Wherein the light exiting the taller side has less radiant intensity (W/sr) than the light exiting the shorter side.

Wherein the convex section extends from a first side of the optical axis to a second side of the optical axis opposite the first side.

Wherein the exterior surface of the second end includes a second planar section, and the convex section is positioned between the first planar section and the second planar section.

Wherein the optical axis separates a taller side of the lens as measured in a direction parallel to the optical axis from a shorter side of the lens, the taller side being disposed on the common side of the optical axis and the first planar section being disposed on the other side of the optical axis.

Wherein the junction between the first planar section and the convex section is angular.

Wherein the second planar section is disposed on the taller side of the lens, and the junction between the second planar section and the convex section is curvilinear.

Wherein the height of the lens decreases in the convex section as the distance from the optical axis increases.

Wherein convex section defines the tallest portion of the lens.

Wherein portions of the convex section located nearer to the first planar section have smaller radii of curvature than portions of the convex section located farther from the first planar section.

Wherein the cross-section of the convex section is linear in a plane perpendicular to the optical axis and perpendicular to the longitudinal axis.

Wherein said reflecting the directed second portion of LED light includes internally reflecting light propagating through a lens off an external surface of the lens.

Wherein said redirecting the reflected second portion of LED light includes refracting light exiting a lens with a planar surface.

Wherein the means includes a convex exterior surface extending across the optical axis.

Wherein the means includes a planar exterior surface adjacent the convex exterior surface and the planar exterior surface is configured to decrease the height of the lens as the distance from the optical axis increases.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
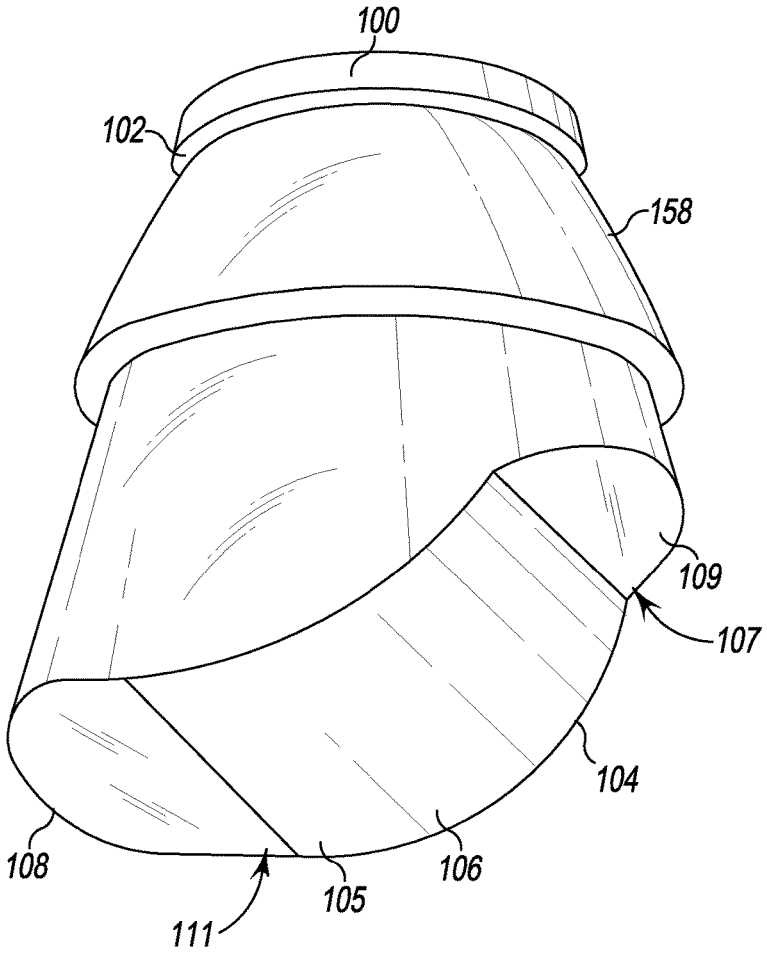
FIG. 1 is a perspective view of a lens according to a first embodiment of the present disclosure.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Embodiments of the present disclosure include a lens for directing light in a luminaire (e.g., a lighting fixture) in a particular direction that is not aligned with what an observer would expect. For example, at least one embodiment includes a luminaire that is vertically oriented when installed (such as a pendant light fixture depicted in FIG. 7 or a the recessed light fixture depicted in FIG. 8), but directs the light emanating from the fixture to one side of the luminaire, such as to illuminate a wall located near the vertically oriented luminaire.

Figure 2:
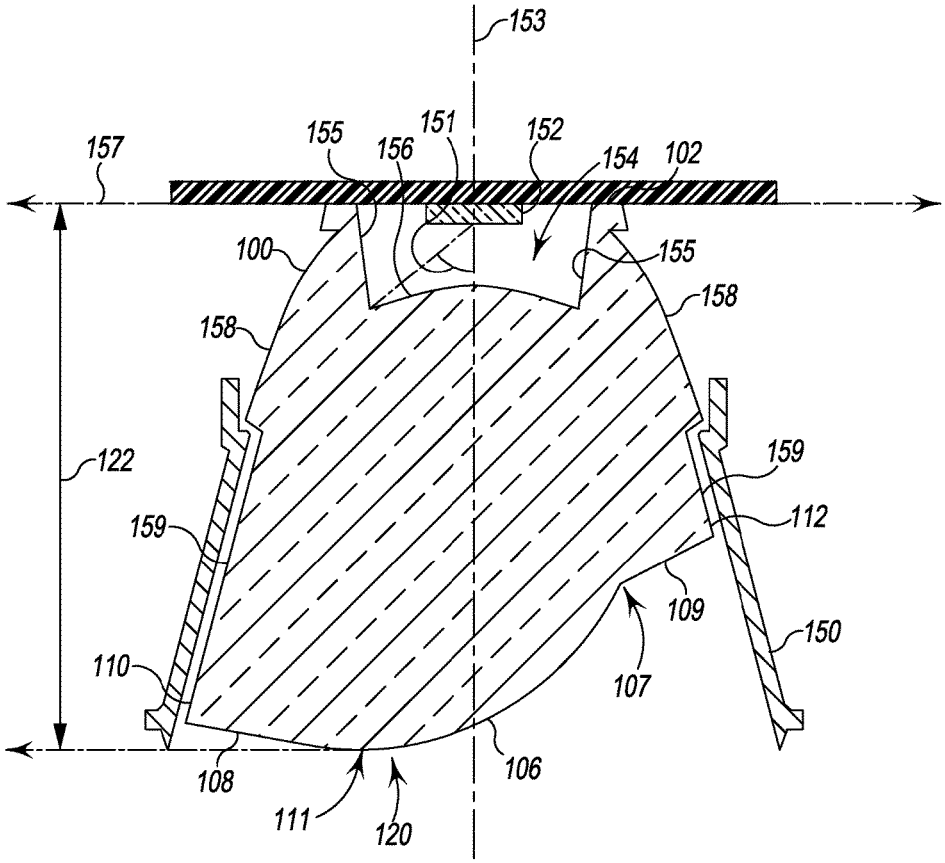
FIG. 2 is a cross-sectional view of the embodiment shown in FIG. 1 mounted within a light fixture.
Figure 3:
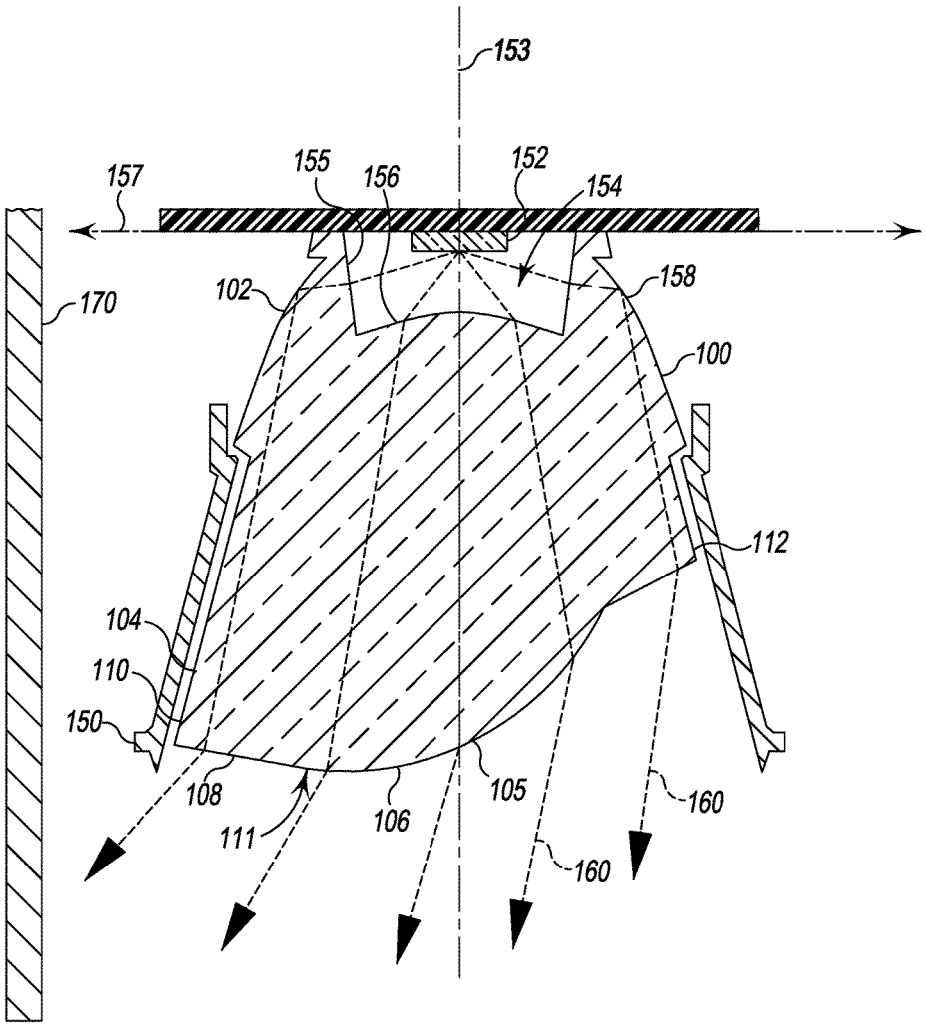
FIG. 3 is a cross-sectional view of the embodiment shown in FIG. 2 illustrating exemplary light rays and with section lines removed for clarity.

Depicted in FIGS. 1-3 is a lens 100 according to one embodiment of the present disclosure. Lens 100 includes a first end 102 and a second end 104, and defines a central optical axis 153. Example directions discussed herein (e.g., vertical and horizontal) are generally relative to the central optical axis 153, which may be described as a vertical axis since many implementations of lens 100 and the fixture into which lens 100 is mounted are vertically oriented. However, it should be appreciated that the optical axis 153 can be oriented in any direction.

The first end 102 of lens 100 is rotationally symmetric about the central optical axis 153 and includes a cavity 154 configured and adapted to receive a light emitting diode (e.g., LED 152, which defines an optical axis that is aligned with the central optical axis 156 of the lens 100). The cavity 154 includes a central surface 156 and a side surface 155 and is rotationally symmetric about the central optical axis 153. The central surface 156 is disposed in a direction generally perpendicular to the central optical axis 153 (e.g., horizontally disposed within an angle, e.g., 20 degrees, of the longitudinal axis 157, or in alternate embodiments within 10 degrees of the longitudinal axis 157), is spherically shaped (i.e., has a circular curve when viewed in cross-section, e.g., as depicted in FIGS. 2 and 3), and refracts light emanating from LED 152 toward the central optical axis 153 (e.g., in a direction more aligned with the central optical axis 153) as seen by the example light pathways 160 depicted in FIG. 3. The side surface 155 is disposed in a direction generally parallel to the central optical axis 153 (e.g., vertically disposed within an angle, e.g., 20 degrees, of the optical axis 153, or in alternate embodiments within 10 degrees of the optical axis 153), forms the outer surface of a right cylinder (e.g., is linear when viewed in cross-section, such as when viewed as depicted in FIGS. 2 and 3), and refracts light emanating from LED 152 toward outer surface 158 as also seen by the example light pathways 160 depicted in FIG. 3. The outer surface 158 of LED lens 100 is an internally reflective surface that reflects light from LED 152 that has entered lens 100 through side surface 155 and directs the light toward the central optical axis 153 (e.g., in a direction more aligned with the central optical axis 153) as further depicted in FIG. 3. Once a particular shape for side surface 155 is established, the shape and slope of outer surface 158 can be carefully designed to result in total internal reflection (TIR) of the LED light entering lens 100 through side surface 155. In the depicted embodiment, side surface 155 is planar and outer surface 158 is freeform with the radius of curvature increasing for the portions of outer surface 158 located further away from longitudinal axis 157.

The second end 104 of lens 100 is located adjacent first end 102, on the other side of lens 100 from cavity 154, is rotationally asymmetric about the central optical axis 153, receives light from the first end 102, and directs the light toward a selected side (also referred to as the dominant side) of the central optical axis 153, e.g., in the direction of longitudinal axis 157. In FIGS. 2 and 3, the selected side is the left side of the figures. The second end 104 includes an exterior surface, e.g., an exit surface 105, which includes a convex surface portion 106. The convex surface portion 106 extends between locations 111 and 107 and from one side of the central optical axis 153 to the other side of the central optical axis 153.

In some embodiments, which includes the embodiment depicted in FIGS. 1-3, the exit surface 105 can include a first planar surface portion 108 located between a first side 110 of lens 100 and the end location 111 of convex surface portion 106, a second planar surface portion 109 located between the end location 107 of convex surface portion 106 and a second side 112, or both. As such, in alternate embodiments the convex surface portion 106 extends to first side 110, to second side 112, or to both.

As depicted in FIGS. 1-3, the first planar surface portion 108 can slope toward central optical axis 153 and in the direction that light propagates along central optical axis 153, positioning the maximum height 122 of lens 100 at a location 120 that is a distance from first side 110, e.g., between side surface 110 and side surface 112. However, in alternate embodiments the first planar surface portion 108 can be perpendicular to central optical axis 153, or the first planar surface portion 108 can slope toward central optical axis 153 and in the direction opposite to which light propagates along central optical axis, positioning the maximum height 122 of lens 100 at the first side 110. The location 120 of maximum height 122 of lens 100 occurs between the first side 110 and the central optical axis 153 in the illustrated embodiment.

The second planar surface portion 109 is depicted as sloping from end location 107 to second side 112 in a direction generally along the same direction as the slope of convex surface portion 106 as convex surface portion 106 approaches location 107 (i.e., the slope of planar surface portion 109 does not reverse direction in comparison to the portion of convex surface portion 106 adjacent second planar surface portion 109), and continues in a direction with a component along the central axis 153 that is opposite to which light propagates. Stated differently, the height of lens 100 decreases as the convex surface portion 106 approaches end location 107 and the height of lens 100 continues to decrease between location 107 and the second side 112.

The shape of exit surface 105 is depicted as being a two-dimensional (2D) curved surface. In other words, the intersection between the exit surface 105 and a plane perpendicular to longitudinal axis 157 (in other words, a plane perpendicular to the page in which FIG. 3 is depicted (which is defined by a plane including both the optical axis 153 and the longitudinal axis 157) and parallel to optical axis 153) forms a straight line. Stated differently, a straight edge oriented perpendicular to the optical axis 153 and the longitudinal axis 157 (i.e., perpendicular to the page in which FIG. 3 is depicted) will contact the exit surface 105 along a line from the side closest to the observer of FIG. 3 to the side farthest from the observer of FIG. 3. As such, in embodiments where exit surface 105 is a 2D curved surface, the first planar surface portion 108 and the second planar surface portion 109 each form flat, planar surfaces. The shape of the convex surface portion 106, however, is a curved freeform surface as depicted with the radius of curvature for portions nearer to first planar surface 108 being of slightly smaller radius than the radius of curvature of portions nearer to second planar surface 109, i.e., the radius of curvature increasing between first planar surface 108 and second planar surface 109. In other embodiments, the curvature of convex surface portion 106 is circular or nearly circular so that a person of ordinary skill will find it difficult to distinguish between the nearly circular surface and the circular surface with the naked eye. The plane including both optical axis 153 and longitudinal axis 157 (i.e., the page in which FIG. 3 is depicted) is also a plane of symmetry for lens 100 with the portions of lens 100 on either side of this plane being mirror images of one another.

The transition from the first planar surface portion 108 and the convex surface portion 106 is curvilinear (e.g., smooth and continuous), while the transition between the convex surface portion 106 and the second planar surface portion 109 is angular (e.g., abrupt and discontinuous, i.e., with a small radius of curvature so that the transition appears discontinuous). However, in at least one embodiment the exit surface 105 is modified so that the transition between the convex surface portion 106 and the second planar surface portion 109 is curvilinear and there are no discontinuities along exit surface 105. In still further embodiments, the exit surface 105 is modified so that the transition from the first planar surface portion 108 and the convex surface portion 106 is angular, or the transition from the first planar surface portion 108 and the convex surface portion 106 is angular and the transition between the convex surface portion 106 and the second planar surface portion 109 is curvilinear.

The shape of the exit surface 105 is formed such that all light emitting from exit surface 105 is directed to a common (or dominant) side of optical axis 153 and lens 105, which in FIG. 3 is toward the left side of the figure. The exit surface 105 directs (e.g., refracts) the light so that the light exiting the dominant side of lens 100 (e.g., the side near first side 110 and first planar surface portion 108, which is the left side of lens 100 in FIG. 3) at a greater angle with respect to the optical axis 153 (e.g., the light being directed more sideways, or with a higher component perpendicular to the optical axis 153) than the light exiting the non-dominant side of lens 100 (e.g., the side near second side 112 and second planar surface portion 109, which is the right side of lens 100 in FIG. 3). The result is that the light exiting exit surface 105 has an asymmetric wide dispersion, or gradational, light pattern having homogeneous intensity down the wall 170 adjacent to the lens 100, i.e., in a direction parallel to the central optical axis 153. In other words, the light emanating from lens 100 has a homogeneous intensity when reaching wall 170 (e.g., generally homogeneous lux (lumens per square meter) on wall 170), which can be depicted with the exemplary light rays 160 reaching wall 170 with generally equal spacing, and the light emanating from lens 100 would not have a homogeneous radiant intensity as measured in watts per steradian (e.g., homogeneous intensity on a sphere surrounding the lens 100). Without the distributed illumination pattern, the light near the top of an adjacent wall 170 may have a higher intensity (e.g., would be brighter) than the lower part of the wall 170. This illumination pattern has advantages when illuminating a surface, e.g., wall 170, when the lens 100 is horizontally displaced from an upper portion of the wall 170 as shown in FIG. 3

In alternate embodiments, the shape of exit surface 105 is a three-dimensional (3D) curved surface. In other words, the intersection between the exit surface 105 and a plane perpendicular to the longitudinal axis 157 forms a curved line. Stated differently, a straight edge oriented perpendicular to the optical axis 153 and the longitudinal axis 157 will contact the exit surface 105 at a single point between the side closest to the observer of FIG. 3 to the side farthest from the observer of FIG. 3, and the point will happen to be located in the plane of the page, i.e., in the plane of optical axis 153 and longitudinal axis 157. In these embodiments, the first planar surface portion 108 and the second planar surface portion 109 will each form a curved surface in the plane perpendicular to longitudinal axis 157. The shape of the convex surface portion 106 in these embodiments is typically a freeform shape in both (i) the plane including the optical axis 153 and the longitudinal axis 157 and (ii) the plane perpendicular to the longitudinal axis 157. However, in alternate embodiments the surface of convex surface portion 106 can be other shapes (e.g., parabolic, elliptical, circular) in either or both (i) the plane including the optical axis 153 and the longitudinal axis 157 and (ii) the plane perpendicular to the longitudinal axis 157.

When the LED 152 is illuminated, light propagating from LED 152 within angle 151, which defines a cone with angle 151 and a vertex collocated with the LED 152, is received by central surface 156 and refracted toward exit surface 105. At least some of this light, which may have propagated from the LED 152 within a cone defined by an angle smaller than angle 151, will reach the convex surface portion 106 of exit surface 105 and be refracted by the convex surface portion 156. Light propagating from LED 152 outside angle 151 is received by side surface 155 and refracted toward outer surface 158, where it is internally reflected toward exit surface 105. The LED light reaching exit surface 105 is refracted toward the dominant side of lens 100, and in a gradational pattern that results in the intensity of the light being relatively constant in the vertical direction.

In FIG. 2, angle 151 also defines the juncture between central surface 156 and side surface 155, although in other embodiments this is not the case. For example, in some embodiments a portion of central surface 156 near side surface 155 is shaped so that the LED light reaching this portion of central surface 156 reflects off central surface 156 toward side surfaced 156 instead of refracting through central surface 165 toward exit surface 105.

Figure 4:
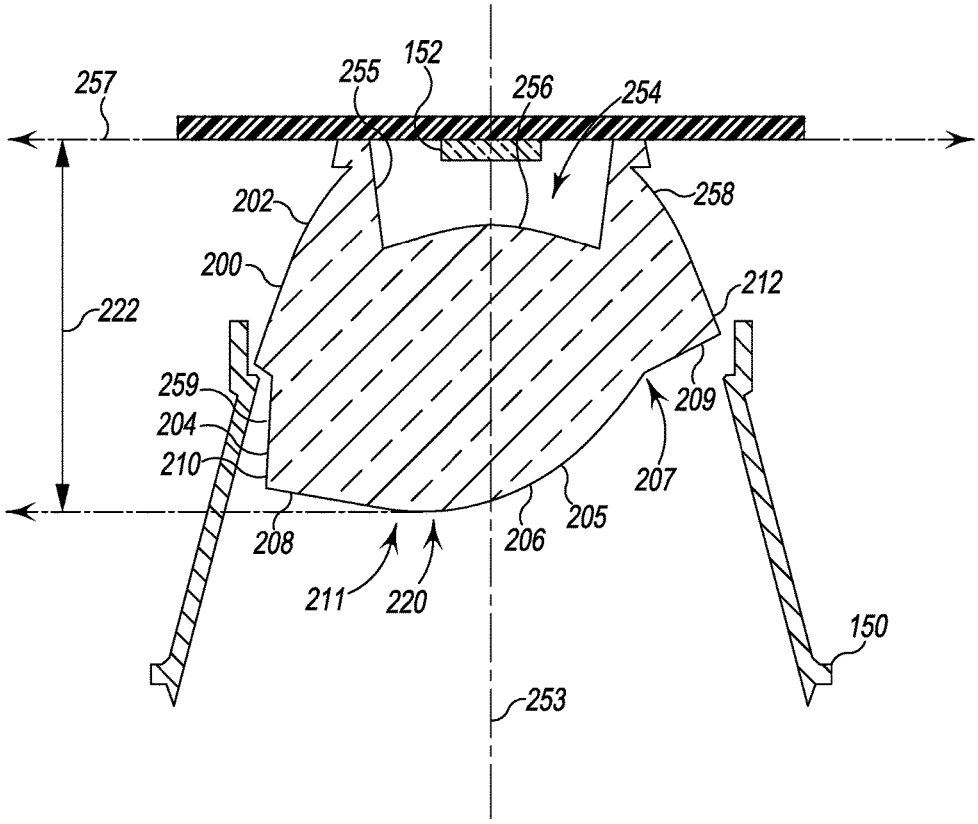
FIG. 4 is cross-sectional view of a lens according to a second embodiment the present disclosure.
Figure 5:
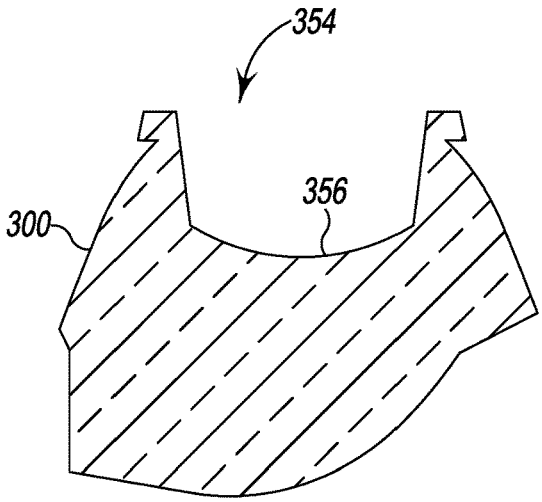
FIG. 5 is a cross-sectional view of a lens according to a third embodiment of the present disclosure.
Figure 6:
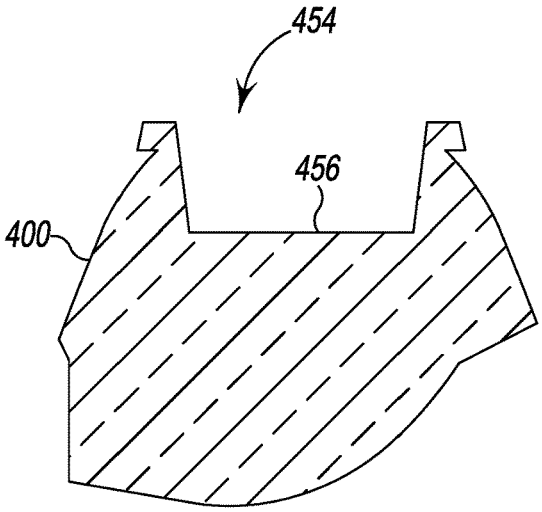
FIG. 6 is a is a cross-sectional view of a lens according to a fourth embodiment of the present disclosure.

Elements depicted in FIGS. 4-6 with reference numerals similar to (e.g., with the last two digits being the same) or the same as those depicted in other figures, e.g., FIGS. 1-3, are similar to (or the same as) and function similarly to (or the same as) the elements in the other figures except as shown and/or described.

Depicted in FIG. 4 is a lens 200 according to a second embodiment of the present disclosure. Lens 200 is similar to lens 100, and includes a first end 202, with a cavity 254 defining a side surface 255 and a central surface 256. The central surface 256 is curved similarly to the central surface 156 and light from LED 152 enters and propagates through lens 200 similarly to how light from LED 152 enters and propagates through lens 100. Lens 200 includes an outer surface 258 that internally reflects light from LED 152 to align the LED light more with the optical axis 253. Lens 200 also includes a second end 204 with an exit surface 205. And, exit surface 205 includes a convex surface portion 206 extending from ends 211 to 207 and positioned between and adjacent to first planar surface portion 208 and second planar surface portion 209, with first and second planar surface portions 208 and 209 extending to sides 210 and 212 of lens 200, respectively.

Lens 200 also defines a maximum height 222 located at position 220 along the convex surface portion 206. As can be seen by comparing lens 100 and lens 200, lens 200 is shorter than lens 100, which for similarly sized first ends (e.g., first end 202 and first end 101) of lens 200 and lens 100, the maximum height of lens 200 is less than the maximum height of lens 100. Although lens 200 is shorter than lens 100, lens 200 still includes convex surface portion 206 and planar surface portions 208 and 209 in a similar arrangement and shape to convex surface portion 106 and planar surface portions 108 and 109 of lens 100, although the specific curvature of convex surface portion 206 and the angular orientations of planar surface portions 208 and 209 may vary slightly from the specific curvature of convex surface portion 106 and the angular orientations of planar surface portions 108 and 109. By having the maximum height 222 of lens 200 less than the maximum height 122 of lens 100, lens 200 can be recessed further into the same light fixture 150, thereby reducing the glare experienced by an observer of light fixture 150. The side surface 259 of lens 200 is also oriented in a direction approximately parallel with optical axis 253, which is somewhat different from the side surface 159 of lens 100 that is disposed at a greater angle with respect to optical axis 153.

Depicted in FIG. 5 is a lens 300 according to another embodiment of the present disclosure. Lens 300 is similar to lens 200, except the central surface 356 of cavity 354 is shaped differently than the central surface 256 of cavity 254. The central surface 356 of lens 300 is a concave surface that has a circular curvature with a radius slightly larger than the height of the central surface and approximately equal to the distance from the LED lens (when mounted to lens 300) and the central surface 356.

Depicted in FIG. 6 is a lens 400 according to YET another embodiment of the present disclosure. Lens 400 is similar to lens 200, except the central surface 456 of cavity 454 is shaped differently than the central surface 256 of cavity 254. The central surface 456 of lens 400 is a planar surface that is oriented approximately perpendicular to the optical axis.

Manufacturing lenses disclosed herein according to embodiments of the present disclosure include forming the disclosed elements (e.g., sides, portions and surfaces) in the shapes and configurations disclosed herein to propagate light as disclosed herein.

Figure 7:
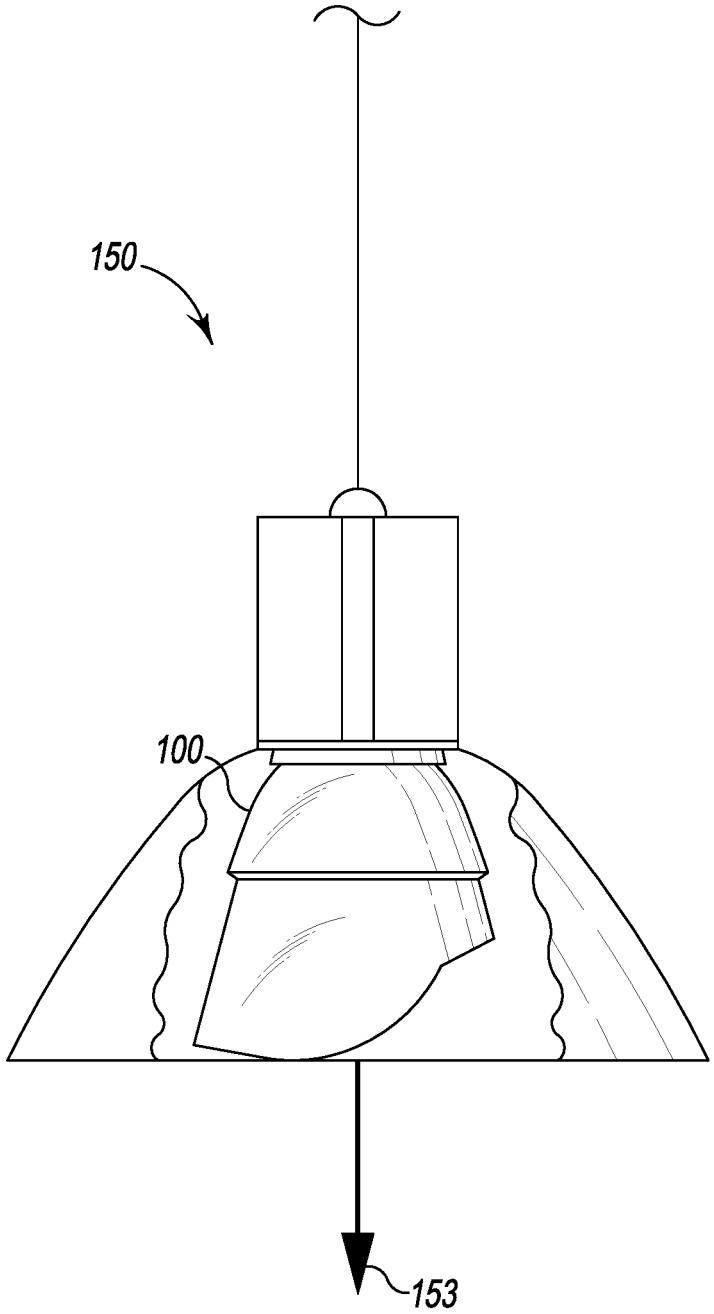
FIG. 7 is a perspective view a light fixture and lens according to one embodiment of the present disclosure.

FIG. 7 depicts an example light fixture 150 that can contain one of the embodiment lenses disclosed herein according to one embodiment of the present disclosure. For example, light fixture 150 (which can be referred to as a high bay or pendant light fixture) is depicted as including lens 100, with the optical axis 153 in alignment with the suspension structure located above the fixture and with dominant side of lens 100 being on the left side of FIG. 7. In use. the light fixture 150 would be located near a wall and, which light fixture 150 appeared to be a down-light, light fixture 150 would instead be a wall washer enhancing the appearance of the wall and presenting a more desirable configuration than fixtures that must be tilted to be effective wall washers.

Figure 8:
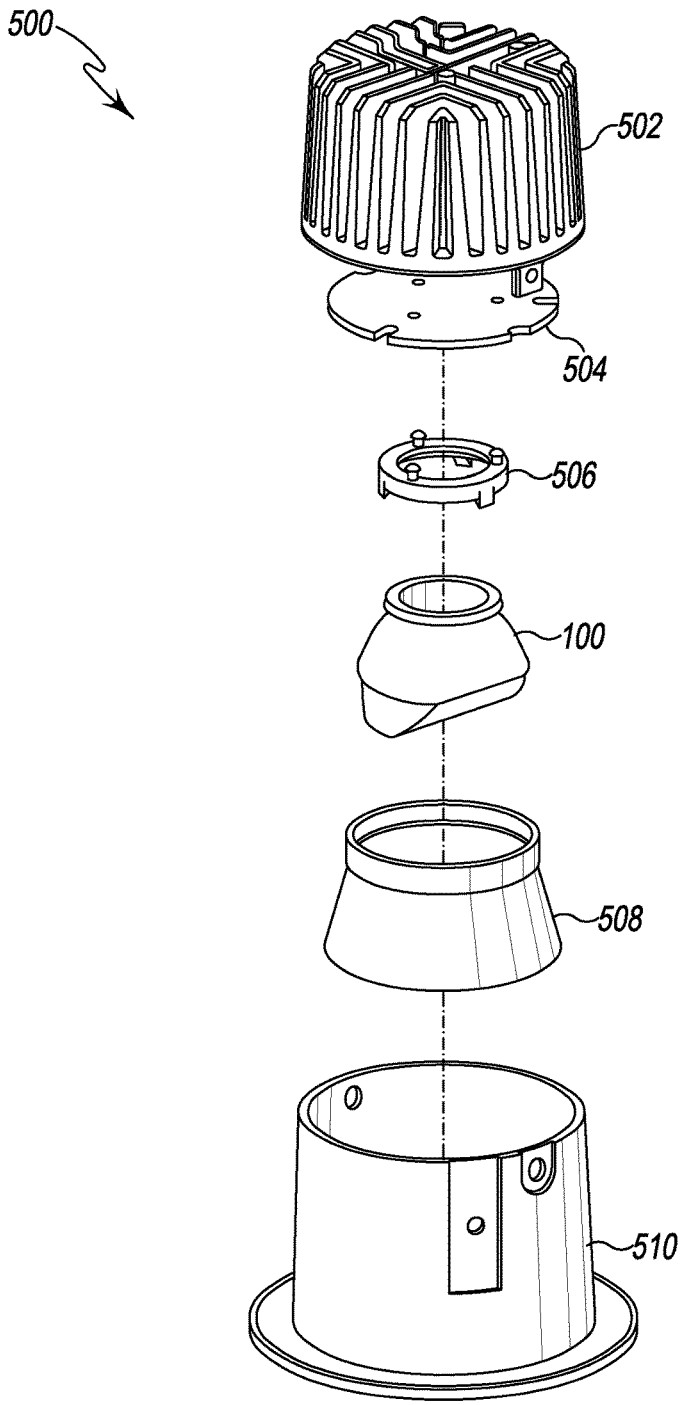
FIG. 8 is an exploded, perspective view of a light fixture and lens according to another embodiment of the present disclosure.

A light fixture 500 according another embodiment of the present disclosure is illustrated in FIG. 8. Light fixture 500 (which can be referred to as a deep regress light fixture) includes a driver section 502 with air vents to dissipate heat generated by the driver, a printed circuit board (PCB) with an LED (mounted on the bottom of the PCT and, therefore, not visible in FIG. 8), a lens 100, a lens mounting bracket 506 for connecting the lens 100 to the light fixture 500, a collar 508 for shielding the lens 100, and a base 510 for connecting the light fixture 500 to a mounting structure, such as a cutout in a ceiling. In use, the cutout receiving the light fixture 500 would be displaced from a wall, and the lens 100 (or any of the other embodiment lenses disclosed herein) would be oriented to direct the light toward the wall, allowing a fixture that appears to be a down-light to be a wall washer.

Reference systems that may be used herein can refer generally to various directions (e.g., upper, lower, forward and rearward), which are merely offered to assist the reader in understanding the various embodiments of the disclosure and are not to be interpreted as limiting. Other reference systems may be used to describe various embodiments, such as referring to the direction of projectile movement as it exits the firearm as being up, down, rearward or any other direction.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used in combination with some or all of the features of other embodiments as would be understood by one of ordinary skill in the art, whether or not explicitly described as such. One or more exemplary embodiments have been shown and described, and all changes and modifications that come within the spirit of the disclosure are desired to be protected.

ELEMENT NUMBERING

The following is a list of element numbers and at least one noun used to describe that element. It is understood that none of the embodiments disclosed herein are limited to these descriptions, and these element numbers can further include other words that would be understood by a person of ordinary skill reading and reviewing this disclosure in its entirety.

100/200/300/400 LED lens
102/202 first end
104/204 second end
105/205 exit surface
106/206 convex surface portion
107/207 end location of convex surface portion 106
108/208 first planar surface portion
109/209 second planar surface portion
110/210 first side
111/211 end location of convex surface portion 106
112/212 second side
120/220 location of maximum height of lens 100
122/222 maximum height of lens 100
150 lighting fixture
151 angle differentiating between light directed toward exit surface 105 and light directed toward outer surface 158
152 LED
153/253 central optical axis
154/254/354/454 cavity
155/255 side/vertical surface
156/256/356/456 central/horizontal surface
157/257 longitudinal axis
158/258 outer surfaces
159/259 side surface
160 example light propagation pathways
170 wall

500 luminaire
502 heat sink
504 PCB
506 lens mounting bracket
508 collar
510 base

What is claimed is:

1. A lens for an LED light fixture, comprising:

a lens defining an optical axis and configured to direct light toward a common side of the optical axis, the lens including first and second ends, the first end of the lens defining a cavity configured to receive an LED light source, the first end portion being configured to direct light from an LED light source received within the cavity to the second end of the lens, the first end being rotationally symmetric with respect to the optical axis, and the second end of the lens defining an exterior surface configured to emit light received from the first end, the second end being rotationally asymmetric with respect to the optical axis, and the exterior surface including a convex section and a first planar section adjacent one another, wherein the height of the lens decreases in the first planar section as the distance from the optical axis increases;

wherein the optical axis separates a taller side of the lens from a shorter side of the lens and the height of the lens is measured in a direction parallel to the optical axis, and wherein the taller side is disposed on the common side of the optical axis; and wherein the light exiting the taller side has less radiant intensity (W/sr) than the light exiting the shorter side.

2. The lens of claim 1, wherein the common side of the optical axis is defined by a longitudinal axis, and wherein the lens directs light at a radiant intensity that results in the light reaching a wall with constant brightness along a direction parallel to the optical axis, and wherein the wall is perpendicular to the longitudinal axis.

3. The lens of claim 1, wherein the first end includes an internally reflective surface;

the cavity includes a central convex surface disposed in a generally perpendicular orientation to the optical axis and configured to refract light emanating from an LED light source positioned within the cavity in a direction more aligned with the optical axis, and a side cylindrical surface disposed in a direction generally parallel to the optical axis and configured to refract light emanating from an LED light source positioned within the cavity toward the internally reflective surface; and the internally reflective surface reflects light received from the side cylindrical surface in a direction more aligned with the optical axis.

4. The lens of claim 1, wherein the convex section extends from a first side of the optical axis to a second side of the optical axis opposite the first side.

5. The lens of claim 1, wherein the exterior surface of the second end includes a second planar section, and the convex section is positioned between the first planar section and the second planar section.

6. The lens of claim 5, wherein the optical axis separates a taller side of the lens as measured in a direction parallel to the optical axis from a shorter side of the lens, the taller side being disposed on the common side of the optical axis and the first planar section being disposed on the other side of the optical axis, and wherein the junction between the first planar section and the convex section is angular.

7. The lens of claim 6, wherein the second planar section is disposed on the taller side of the lens, and the junction between the second planar section and the convex section is curvilinear.

8. The lens of claim 6, wherein the height of the lens decreases in the convex section as the distance from the optical axis increases.

9. The lens of claim 6, wherein convex section defines the tallest portion of the lens.

10. The lens of claim 1, wherein portions of the convex section located nearer to the first planar section have smaller radii of curvature than portions of the convex section located farther from the first planar section.

11. The lens of claim 10, wherein the cross-section of the convex section is linear in a plane perpendicular to the optical axis and perpendicular to the longitudinal axis.

12. A method, comprising:

receiving a first portion of LED light propagating from an LED defining an optical axis, wherein the first portion of LED light propagates within a cone of a predetermined angle centered on the LED optical axis with a vertex collocated with the LED;

directing the received first portion of LED light to align more with the optical axis;

redirecting the first portion of LED light toward a preferred side of the LED optical axis with a curved refractive surface;

receiving a second portion of LED light propagating from the LED outside the cone of a predetermined angle centered on the LED optical axis with a vertex collocated with the LED;

directing the received second portion of LED light toward a reflective surface;

reflecting the directed second portion of LED light to align more with the optical axis; and redirecting the reflected second portion of LED light toward the preferred side of the LED optical axis with a planar refractive surface;

wherein said redirecting the reflected second portion of LED light includes refracting light exiting a lens with a planar surface.

13. The method of claim 12, wherein said reflecting the directed second portion of LED light includes internally reflecting light propagating through a lens off an external surface of the lens.

14. The method of claim 12, wherein said redirecting the first portion of LED light includes refracting light exiting a lens with the curved refractive surface.

15. A lens for an LED light fixture, comprising:

a lens defining an optical axis and configured to direct light toward a common side of the optical axis, the lens including first and second ends, the first end of the lens defining a cavity configured to receive an LED light source, the first end portion being configured to direct light from an LED light source received within the cavity to the second end of the lens, the first end being rotationally symmetric with respect to the optical axis, and the second end of the lens defining an exterior surface configured to emit light received from the first end, the second end being rotationally asymmetric with respect to the optical axis, and the exterior surface including a convex section and a first planar section adjacent one another, wherein the height of the lens decreases in the first planar section as the distance from the optical axis increases;

wherein the exterior surface of the second end includes a second planar section, and the convex section is positioned between the first planar section and the second planar section.

16. The lens of claim 15, wherein the common side of the optical axis is defined by a longitudinal axis, and wherein the lens directs light at a radiant intensity that results in the light reaching a wall with constant brightness along a direction parallel to the optical axis, and wherein the wall is perpendicular to the longitudinal axis.

17. The lens of claim 15, wherein the first end includes an internally reflective surface;

the cavity includes a central convex surface disposed in a generally perpendicular orientation to the optical axis and configured to refract light emanating from an LED light source positioned within the cavity in a direction more aligned with the optical axis, and a side cylindrical surface disposed in a direction generally parallel to the optical axis and configured to refract light emanating from an LED light source positioned within the cavity toward the internally reflective surface; and the internally reflective surface reflects light received from the side cylindrical surface in a direction more aligned with the optical axis.

18. The lens of claim 15, wherein the optical axis separates a taller side of the lens from a shorter side of the lens and the height of the lens is measured in a direction parallel to the optical axis, and wherein the taller side is disposed on the common side of the optical axis.

19. The lens of claim 15, wherein the convex section extends from a first side of the optical axis to a second side of the optical axis opposite the first side.

20. The lens of claim 15, wherein the optical axis separates a taller side of the lens as measured in a direction parallel to the optical axis from a shorter side of the lens, the taller side being disposed on the common side of the optical axis and the first planar section being disposed on the other side of the optical axis, and wherein the junction between the first planar section and the convex section is angular.

21. The lens of claim 20, wherein the second planar section is disposed on the taller side of the lens, and the junction between the second planar section and the convex section is curvilinear.

22. The lens of claim 20, wherein the height of the lens decreases in the convex section as the distance from the optical axis increases.

23. The lens of claim 20, wherein convex section defines the tallest portion of the lens.

24. The lens of claim 15, wherein portions of the convex section located nearer to the first planar section have smaller radii of curvature than portions of the convex section located farther from the first planar section.

25. The lens of claim 24, wherein the cross-section of the convex section is linear in a plane perpendicular to the optical axis and perpendicular to the longitudinal axis.

26. A lens for an LED light fixture, comprising:

a lens defining an optical axis and configured to direct light toward a common side of the optical axis, the lens including first and second ends, the first end of the lens defining a cavity configured to receive an LED light source, the first end portion being configured to direct light from an LED light source received within the cavity to the second end of the lens, the first end being rotationally symmetric with respect to the optical axis, and the second end of the lens defining an exterior surface configured to emit light received from the first end, the second end being rotationally asymmetric with respect to the optical axis, and the exterior surface including a convex section and a first planar section adjacent one another, wherein the height of the lens decreases in the first planar section as the distance from the optical axis increases;

wherein portions of the convex section located nearer to the first planar section have smaller radii of curvature than portions of the convex section located farther from the first planar section.

27. The lens of claim 26, wherein the common side of the optical axis is defined by a longitudinal axis, and wherein the lens directs light at a radiant intensity that results in the light reaching a wall with constant brightness along a direction parallel to the optical axis, and wherein the wall is perpendicular to the longitudinal axis.

28. The lens of claim 26, wherein the first end includes an internally reflective surface;

the cavity includes a central convex surface disposed in a generally perpendicular orientation to the optical axis and configured to refract light emanating from an LED light source positioned within the cavity in a direction more aligned with the optical axis, and a side cylindrical surface disposed in a direction generally parallel to the optical axis and configured to refract light emanating from an LED light source positioned within the cavity toward the internally reflective surface; and the internally reflective surface reflects light received from the side cylindrical surface in a direction more aligned with the optical axis.

29. The lens of claim 26, wherein the optical axis separates a taller side of the lens from a shorter side of the lens and the height of the lens is measured in a direction parallel to the optical axis, and wherein the taller side is disposed on the common side of the optical axis.

30. The lens of claim 26, wherein the convex section extends from a first side of the optical axis to a second side of the optical axis opposite the first side.

31. The lens of claim 30, wherein the exterior surface of the second end includes a second planar section, and the convex section is positioned between the first planar section and the second planar section; and wherein the optical axis separates a taller side of the lens as measured in a direction parallel to the optical axis from a shorter side of the lens, the taller side being disposed on the common side of the optical axis and the first planar section being disposed on the other side of the optical axis, and wherein the junction between the first planar section and the convex section is angular.

32. The lens of claim 31, wherein the second planar section is disposed on the taller side of the lens, and the junction between the second planar section and the convex section is curvilinear.

33. The lens of claim 31, wherein the height of the lens decreases in the convex section as the distance from the optical axis increases.

34. The lens of claim 31, wherein convex section defines the tallest portion of the lens.

35. The lens of claim 26, wherein the cross-section of the convex section is linear in a plane perpendicular to the optical axis and perpendicular to the longitudinal axis.

* * * * *